United States Patent [19]

Miyagi

[11] 4,364,347

[45] Dec. 21, 1982

[54] METHOD OF ADJUSTING IDLE SPEED OF AN INTERNAL COMBUSTION ENGINE

[75] Inventor: Hideo Miyagi, Okazaki, Japan

[73] Assignee: Toyota Jidosha Kogyo Kabushiki Kaisha, Toyota, Japan

[21] Appl. No.: 188,213

[22] Filed: Sep. 17, 1980

[30] Foreign Application Priority Data

Sep. 20, 1979 [JP] Japan ..... 54-120026

[51] Int. Cl.[3] ..... F02M 23/06

[52] U.S. Cl. ..... 123/339; 123/585

[58] Field of Search ..... 123/339, 585, 587, 352

[56] References Cited

U.S. PATENT DOCUMENTS 2,499,263 2/1950 Troy ..... 123/339

3,964,457 6/1976 Coscia ..... 123/339

4,240,145 12/1980 Yano et al. ..... 123/585

*Primary Examiner*—Charles J. Myhre

*Assistant Examiner*—Andrew M. Dolinar

*Attorney, Agent, or Firm*—Kenyon & Kenyon

[57] ABSTRACT

Idle speed of an internal combustion engine is adjusted by applying a drive signal having a predetermined value to a flow rate control mechanism which is disposed in a main bypass passage bypassing a throttle valve while the flow rate control mechanism is energized by the drive signal to operate the engine at close to a desired idling speed, a flow rate adjustment screw in a second bypass passage also bypassing the throttle valve is adjusted to cause the actual speed of the engine to become equal to the desired idle speed.

5 Claims, 6 Drawing Figures

METHOD OF ADJUSTING IDLE SPEED OF AN INTERNAL COMBUSTION ENGINE

BACKGROUND OF THE INVENTION

The present invention relates to an idle speed adjustment method for an internal combustion engine which has an idle speed feedback control system.

There is known a feedback control system for controlling the idle speed of an internal combustion engine by controlling the flow rate of air taken into the engine when the engine is in the idling or decelerating condition, that is, when a throttle valve disposed in an intake passage of the engine is at the idle position. In such an idle speed feedback control system, the flow rate of intake air is controlled by an air control valve disposed in a passage bypassing the throttle valve. The air control valve controls either the cross-sectional area or the opened time period of the bypass passage in response to a drive signal representing the difference between the detected actual rotational speed of the engine and a desired idle speed. Adjustment of the idle speed of an internal combustion engine having such a system can be carried out by turning an idle speed adjustment screw, which is disposed in a second bypass passage connected to the intake passage parallel to the aforementioned bypass passage.

In a conventional idle speed adjustment method, the idle speed is adjusted under a condition in which the air control valve is not energized, that is, the air control valve is fully closed. Under this condition, according to the conventional method, the idle speed adjustment screw is turned in or out so that the actual speed of the engine becomes equal to a speed, for example, 500 rpm, which is lower than a desired idle speed, for example, 700 rpm. However, this conventional adjustment method has the following problems:

(1) Since the characteristics of air control valves usually lack uniformity, even if these air control valves are driven by signals of uniform value, the flow rate of air passing through each of the air control valves is different. Therefore, if the air control valves are driven by a uniform value signal, a desired idle speed cannot be obtained in each engine. As a result, in engines whose idle speeds are adjusted according to the conventional adjustment method, it is almost impossible to set the maximum value, minimum value and initial value of the drive signal for energizing the air control valve to uniform values, respectively.

(2) Since the engine speed adjusted according to the conventional adjustment method is very low, the engine runs very roughly during adjustment. Thus, the adjustment of the idle speed is not easy and accurate adjustment of idle speed cannot be expected.

(3) In the engine whose idle speed is adjusted by using the conventional adjustment method, the flow rate of air passing through the second bypass passage to which the idle speed adjustment screw is attached is relatively great, compared to the flow rate of air passing through the air control valve at idling. Therefore, the range of the air flow rate controlled by the air control valve is restricted. As a result, the automatic compensation range with respect to the change in idle speed, particularly to the change in idle speed caused by reduction of friction loss of the engine, according to the idle speed feedback control system cannot be enlarged.

SUMMARY OF THE INVENTION

It is, therefore, an object of the present invention to provide a method of adjusting the idle speed of an internal combustion engine, whereby, in each engine having a similar idle speed control system, a desired idle speed can be obtained when drive signals having a uniform value are applied to the air flow rate control means of each engine.

Another object of the present invention is to provide a method of adjusting the idle speed, whereby the adjustment of the idle speed can be carried out very easily and an accurate adjustment can be expected.

A further object of the present invention is to provide a method of adjusting the idle speed, whereby the compensation range with respect to change in idle speed, according to an idle speed feedback control system, can be enlarged from that of the prior art.

According to the present invention, the first step in the method of adjusting the idle speed of an internal combustion engine is to apply a drive signal having a predetermined value to flow rate control means disposed in a main bypass passage bypassing a throttle valve. Then while the flow rate control means is energized by the above-mentioned drive signal, flow rate adjustment means in a second bypass passage also bypassing the throttle valve is adjusted so that the actual rotational speed of the engine becomes equal to a desired idle speed.

The above and other related objects and features of the present invention will be apparent from the description of the present invention set forth below, with reference to the accompanying drawings, as well as from the appended claims.

DETAILED DESCRIPTION OF THE PREFERRED EMBODIMENTS

Figure 1:
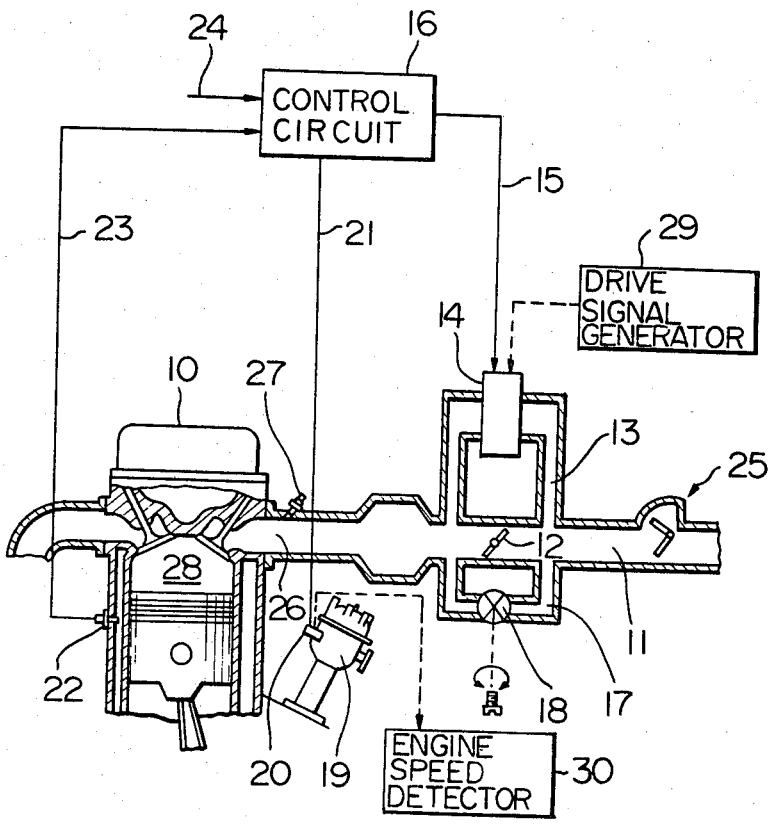
FIG. 1 is a schematic diagram illustrating an embodiment of the present invention.

FIG. 1 illustrates an example of an electronic fuel injection control type internal combustion engine whose idle speed is adjusted by a method and apparatus according to the present invention. FIG. 1 shows an engine block 10 with an intake passage 11 attached to it and a throttle valve 12 in the intake passage 11. A main bypass passage 13 connects a point in the intake passage upstream of the throttle valve 12 with a point between the throttle valve and the block. A flow rate control mechanism 14 is disposed in the main bypass passage 13 for controlling the cross-sectional area of the main bypass passage and is energized by a drive signal fed from a feedback control circuit 16 via a line 15 to control that cross-sectional area. A second bypass passage 17 also bypasses the throttle valve 12 in parallel with the main bypass passage 13. An idle speed adjustment screw 18 is disposed in the second bypass passage 17 and can be turned by hand or by a tool to adjust the idle speed.

A crank angle sensor 20 for generating a crank angle pulse every time the crankshaft of the engine rotates a predetermined angle is attached to a distributor 19. The generated crank angle pulses are fed into the control circuit 16 via a line 21.

A water temperature sensor 22 for detecting the temperature of engine coolant is mounted on a cylinder block of the engine. The detected temperature signal is fed to the control circuit 16 via a line 23.

A detected signal from a throttle position sensor (not illustrated) which detects when the throttle valve 12 is fully closed, i.e., is at idle position, is fed to the control circuit 16 via a line 24.

The control circuit 16 is a well-known idle speed feedback control circuit, which comprises a digital computer of stored program type, an analog-to-digital converter, a speed-signal forming circuit for producing speed signal from the crank angle pulses fed from the sensor 20, and a driver circuit for converting the output from the digital computer to a drive signal applied to and energizing the flow rate control mechanism 14.

When the throttle valve 12 is at its idle position, the control circuit 16 calculates a desired idle speed value as a function of the detected water temperature and then compares the calculated idle speed with the actual speed of the engine. Thereafter, in accordance with the result of the comparison the control circuit determines the value of a drive signal for energizing the flow rate control mechanism 14. As a result, the flow rate of intake air into the engine at idling is controlled so that the actual speed of the engine becomes equal to the above-mentioned desired idle speed.

As is well known, in an electronic fuel injection control type internal combustion engine, the flow rate of intake air into the engine is detected by an air flow sensor 25 in the intake passage 11, and fuel is supplied in an amount determined by the detected flow rate of intake air, into a combustion chamber 28 of the engine from a fuel injection valve 27 mounted in an intake manifold portion 26. Accordingly, the speed of the engine can be controlled by controlling the flow rate of intake air, by either the throttle valve 12 or the flow rate control mechanism 14 or both.

Figure 2:
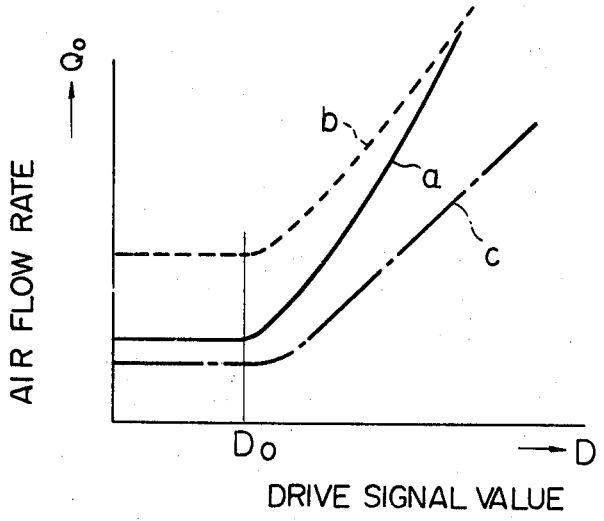
FIGS. 2 and 3 are graphs of the rate of air flow passing through the air control valve versus the drive signal valve thereof, according to the prior art.
Figure 3:
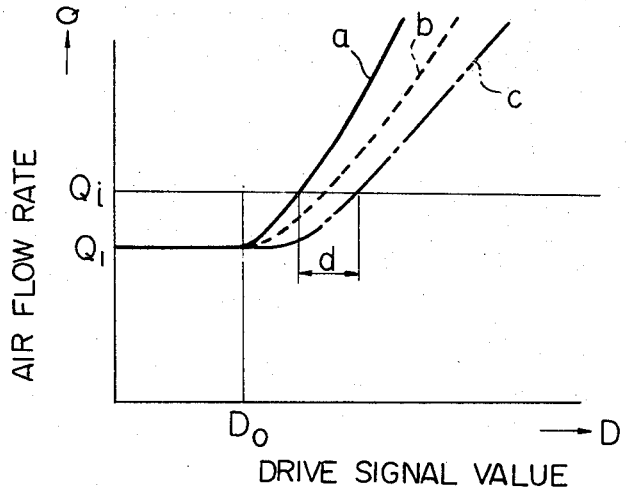

If the idle speed adjustment of the engine having the above-mentioned idle speed feedback system is carried out when no drive signal is applied to the flow rate control mechanism 14, that is, when an air control valve in the flow rate control mechanism 14 is fully closed, several problems occur as mentioned hereinbefore. FIGS. 2 and 3 illustrate the effects of these problems.

In FIG. 2 reference symbols a, b and c represent characteristics between the value D of the drive signal applied to flow rate control mechanisms and the flow rate $Q_0$ of air passing therethrough. As will be apparent from FIG. 2, different flow rate control mechanisms, in general, have different characteristics between the applied drive signal value D and the flow rate $Q_0$. Therefore, relationships between the flow rate Q of intake air into the engines whose idle speeds are adjusted by using the conventional adjustment method and the value D of the drive signal applied to the respective flow rate control mechanisms are different from each other, as illustrated by the reference symbols a, b and c in FIG. 3. In FIG. 3, $Q_i$ represents the air flow rate required by the engine to rotate at the desired idle speed, $Q_1$ represents the air flow rate adjusted by the idle speed adjustment screw 18, namely, the flow rate of air passing through the second bypass passage 17, and $D_0$ represents the drive signal value at which the flow rate control mechanism 14 is fully closed.

As will be apparent from FIG. 3, if the idle speed is adjusted according to the conventional method, the value D of the drive signals applied to the respective flow rate control mechanisms so as to obtain the flow rate $Q_i$ required to rotate the engines at the idle speed vary by an amount d.

Hereinafter, an adjustment method according to the present invention will be illustrated.

Figure 6:
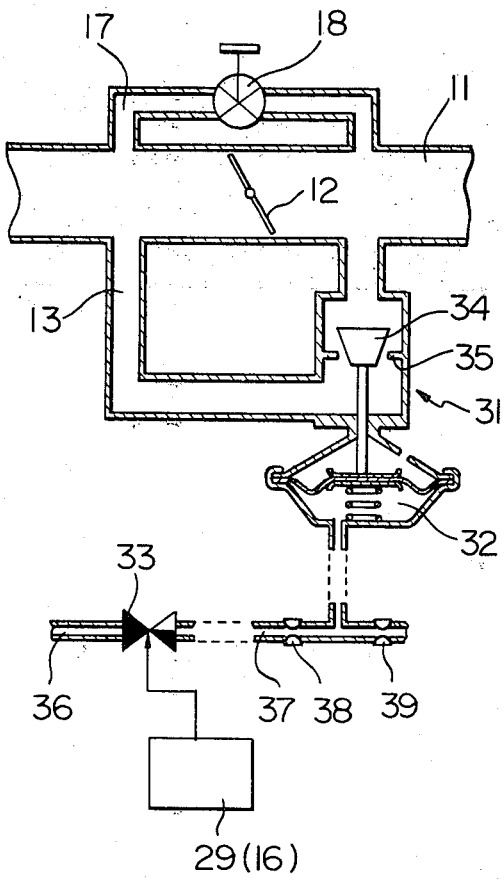
FIG. 6 is a schematic diagram illustrating an example of the structure of a flow rate control mechanism.

Before adjustment, the engine shown in FIG. 1 should be completely warmed-up. An engine speed detector 30, such as a well-known tachometer that indicates the engine rotational speed by receiving the crank angle pulses from the crank angle sensor 20, and a drive signal generator 29 are ready for operating. The drive signal generator 29 generates a drive signal of a type corresponding to the type of the flow rate control mechanism 14. For example, if the flow rate control mechanism 14 is composed of an air control valve of the diaphragm type and an electromagnetic switching valve for controlling the penumatic pressure in the diaphragm chamber of the air control valve, as illustrated in FIG. 6, a signal generator which produces drive signals of a rectangular wave form and a predetermined duty cycle is used for the drive signal generator 29. In a case where the flow rate control mechanism 14 is composed of an electrically driven air control valve whose opening degree is controlled in accordance with the voltage applied thereto, a signal generator which produces a voltage drive signal having a predetermined level is used for the drive signal generator 29. Furthermore, if the flow rate control mechanism 14 is composed of a stepper motor type air control valve, a signal generator which produces drive signals consisting of a predetermined number of pulse signals is utilized for the drive signal generator 24. Since the structures of the above-mentioned drive signal generators are well-known, an explanation of circuits thereof is omitted in this specification.

When the engine is completely warmed up and is operated at idle speed, drive signals of a predetermined value are applied to the input terminal of the flow rate control mechanism 14 from the drive signal generator 29 instead of from the control circuit 16. The value of the drive signals from the drive signal generator 29 is preferably set at a value that will cause the flow rate control mechanism 14 to allow air to flow at the rate necessary to cause the engine to rotate nearly at a desired idle speed. Under the above-mentioned condition, the idle speed adjustment screw 18 is then turned in or out so that the rotational speed monitored by the engine speed detector 30 becomes equal to a desired idle speed in the warmed-up state, for example 700 rpm.

Figure 4:
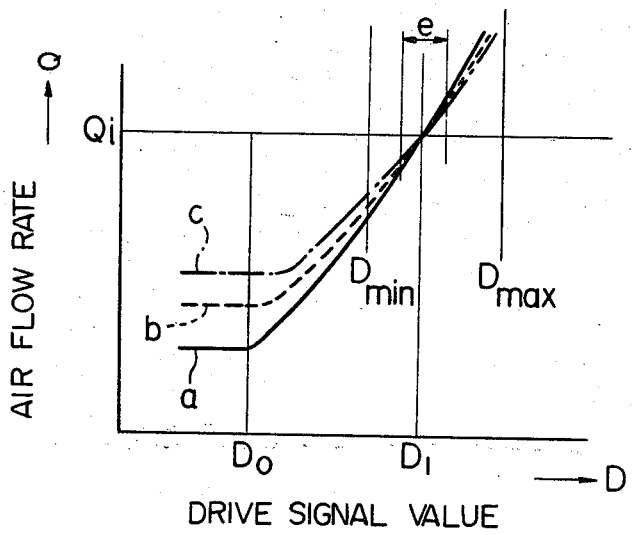
FIGS. 4 and 5 are graphs of the rate of air flow passing through the air control valve versus the drive signal value thereof according to the present invention.

As described hereinbefore, according to the present invention, the idle speed adjustment screw 18 is adjusted so as to obtain a desired idle speed, while the flow rate control mechanism 14 is energized by the drive signals having a predetermined value $D_1$. Therefore, as illustrated in FIG. 4, the drive signal values required by the respective flow rate control mechanisms to obtain the air flow rate $Q_i$, which causes the respective engines to rotate at the desired speed, agree with the value of $D_i$. Furthermore, the drive signal value required by the respective flow rate control mechanisms to obtain the same flow rate near the flow rate of $Q_i$ approximately agree with a uniform value within a range indicated by a reference symbol e in FIG. 4.

In idle speed feedback control systems wherein variable ranges of the value D of the drive signals for energizing the flow rate control mechanisms are restricted by respective upper limits (maximum values) and respective lower limits (minimum values), since a uniform drive signal value can be used for energizing each of the flow rate control mechanisms to cause the engines to rotate at the same speed according to the present invention, the upper and lower limits can be set to a uniform maximum value $D_{max}$ and a uniform minimum value $D_{min}$, respectively, as illustrated in FIG. 4. Therefore, according to the present invention, appropriate and accurate uniform maximum and minimum values can be determined for all of the engines.

The minimum value $D_{min}$ of the drive signal is introduced so as to prevent the flow rate control mechanism from closing excessively in a decelerating condition of the engine, and the maximum value $D_{max}$ is introduced so as to prevent the flow rate control mechanism from opening excessively at high load. If the load of the engine is reduced suddenly while the flow rate control mechanism is excessively opened, the rotational speed of the engine will rapidly increase.

The present invention has the following further advantage. Since the rotational speed of the engine at the time of adjustment is not extremely low, adjustment of idle speed can be carried out very easily and accurate adjustment can be expected.

Figure 5:
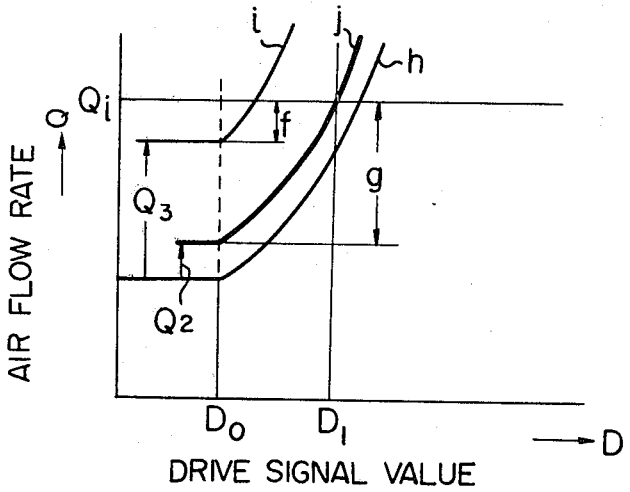

Furthermore, according to the present invention, the compensation range with respect to change in idle speed of the engine by the idle speed feedback control system can be enlarged. FIG. 5 illustrates this advantage of the present invention. As illustrated in FIG. 5, the air flow rate $Q_2$ controlled by the idle speed adjustment screw adjusted by the method according to the present invention is considerably smaller than the air flow rate $Q_3$ controlled by the idle speed adjustment screw adjusted by the prior art method. As a result, the range of the air flow rate which can be compensated for by the flow rate control mechanism is enlarged from f to g, as illustrated in FIG. 5. Therefore, the change in the idle speed after a long time, for example, the change caused by the reduction of the engine's friction loss can be automatically corrected, even if the change is great. In FIG. 5, reference symbols h, i and j represent characteristics of the flow rate control mechanism before adjusting, after adjusting by the prior art, and after adjusting by the present invention, respectively.

FIG. 6 illustrates one example of the structure of the flow rate control mechanism 14 illustrated in FIG. 1. In this mechanism 14, a diaphragm type air control valve 31 is inserted in the main bypass passage 13. An electromagnetic switching valve 33 controls the level of the pneumatic pressure applied to a diaphragm chamber 32 by its on-off operation. The position of a valve body 34 with respect to a valve seat 35 of the air control valve 31 is controlled in accordance with the pneumatic pressure in the diaphragm chamber 32, and thus, the flow rate of air passing through the air control valve 31 is controlled. One port of the switching valve 33 is opened to the atmosphere via a conduit 36, and the other port is connected to the intake manifold of the engine via a conduit 37 and orifices 38 and 39. The diaphragm chamber 32 of the air control valve 31 is connected to the conduit 37 at a position located between the orifices 38 and 39. The switching valve 33 is on-off operated in response to the rectangular wave signals applied from the control circuit 16 or the drive signal generator 29. Therefore, the level of the pneumatic pressure in the diaphragm chamber 32 is controlled corresponding to the duty cycle of the rectangular wave drive signals.

In the aforementioned embodiment, when the idle speed is adjusted, the drive signals having a predetermined value are fed from the drive signal generator 29. However, in another embodiment according to the present invention, the drive signals for adjusting the idle speed can be supplied from the control circuit 16. Furthermore, although, in the aforementioned embodiment, the idle speed adjustment is carried out after the engine is completely warmed up, this adjustment can be performed even when the engine temperature does not exceed a predetermined value. In this case, the value of the drive signal is corrected in accordance with the engine temperature. This correction can be automatically carried out if the control program of the control circuit 16 is somewhat changed.

As many widely different embodiments of the present invention may be constructed without departing from the spirit and scope of the present invention, it should be understood that the present invention is not limited to the specific embodiments described in this specification, except as defined in the appended claims.

I claim:

1. A method of adjusting the idle speed of an internal combustion engine having an intake passage, a throttle valve in the intake passage, main and second bypass passages, each of which separately communicates with the intake passage so as to bypass the throttle valve, flow rate adjustment means in said second bypass passage, and flow rate control means in said main bypass passage, the opening degree of said flow rate control means being controlled in accordance with the rotational speed of the engine, said method comprising the steps of:

applying a drive signal having a predetermined fixed value independent of the actual rotational speed of the engine to the flow rate control means so as to operate the engine at a speed above its lowest operating speed; and while the flow rate control means is energized by said drive signal, adjusting the flow rate adjustment means so that the actual rotational speed of the engine becomes equal to a desired idling speed.

2. The method as claimed in claim 1 in which the drive signal applied to the flow rate control means has a predetermined value to operate the engine at a speed close to the desired idling speed.

3. The method as claimed in claim 1 comprising the additional step of warming up the engine to substantially its normal operating temperature prior to applying the drive signal to the flow rate control means to operate the engine at a speed above its lowest operating speed.

4. The method of claim 1 comprising the additional steps of:

warming up the engine to a temperature less than the normal operating temperature prior to applying the drive signal to the flow rate control means to operate the engine at a speed above its lowest operating speed; and modifying the value of the drive signal from said predetermined value by an amount that is a function of the temperature of the engine at the time of adjusting the idling speed thereof.

5. The combination comprising:

an internal combustion engine;

an intake passage therefor;

a throttle valve in the intake passage;

a main bypass passage connected to the intake passage upstream and downstream of the throttle valve to bypass the throttle valve;

a second bypass passage connected to the intake passage upstream and downstream of the throttle valve to bypass the throttle valve;

flow rate adjustment means in the second bypass passage;

flow rate control means in the main bypass passage;

sensor means to sense the temperature and operating speed of the engine;

a control circuit connected to the sensor means to receive signals therefrom and connected to the flow rate control means to control the passage of air through the main bypass passage to maintain the idling speed of the engine as a function of the temperature of the engine; and a separate drive signal generator connected to the flow rate control means to control the operation thereof during initial adjust of the idling speed of the engine, the drive signal generator providing a predetermined drive signal to set the flow rate control means to a value to operate the engine at a speed above its lowest operating speed while the flow rate adjustment means in the second bypass passage is being adjusted.

* * * * *